United States Patent [19]

Matsuoka et al.

[11] 4,434,766

[45] Mar. 6, 1984

[54] AIR ASSIST DEVICE OF FUEL INJECTION TYPE INTERNAL COMBUSTION ENGINE

[75] Inventors: Hiroki Matsuoka; Yuichi Kato; Minoru Iwata, all of Susono, Japan

[73] Assignee: Toyota Jidosha Kabushiki Kaisha, Toyota, Japan

[21] Appl. No.: 410,843

[22] Filed: Aug. 23, 1982

[30] Foreign Application Priority Data

May 7, 1982 [JP] Japan ..... 57-76969

[51] Int. Cl.[3] ..... F02M 23/00

[52] U.S. Cl. ..... 123/472; 123/531; 239/403; 239/405

[58] Field of Search ..... 123/472, 531–533, 123/585, 590; 239/296, 298, 403, 405

[56] References Cited

U.S. PATENT DOCUMENTS 4,006,719 2/1977 Kanda et al. ..... 239/405

4,216,753 8/1980 Inoue et al. ..... 123/472

*Primary Examiner*—William A. Cuchlinski, Jr.

*Attorney, Agent, or Firm*—Cushman, Darby & Cushman

[57] ABSTRACT

In an air assist device of a fuel injection type internal combustion engine, having an air assisted injector provided close to a nozzle thereof with an adapter constituting an assist air introducing portion, in which assist air introduced into the assist air introducing portion through assist air intake ports formed in the peripheral wall of the adapter is blown out of an assist air jet formed at the bottom of the adapter together with fuel so as to facilitate the atomization of fuel, the diameter of each opening of the assist air intake ports is made smaller than the diameter of an opening of the assist air jet, the assist air intake ports are provided in a plural number, so that the total opening area of the assist air intake ports can be made larger than the opening area of the assist air jet, and/or the assist air intake ports are penetrated in directions tangential to the inner wall surface of the adapter.

9 Claims, 8 Drawing Figures

AIR ASSIST DEVICE OF FUEL INJECTION TYPE INTERNAL COMBUSTION ENGINE

BACKGROUND OF THE INVENTION

1. Field of the Invention

This invention relates to air assist devices of fuel injection type internal combustion engines, and more particularly to improvements in an air assist device of a fuel injection type internal combustion engine, suitable for use in a motor vehicle engine having an electronically controlled fuel injection device, and having an air assisted injector provided close to a nozzle thereof with an adapter constituting an assist air introducing portion, whereby assist air introduced into the assist air introducing portion through assist air intake ports formed in the peripheral wall of the adapter is blown out of an assist air jet formed at the bottom of the adapter together with fuel, so that atomization of fuel can be facilitated.

2. Description of the Prior Art

An electronically controlled fuel injection device has been used in one of systems for controlling the air-fuel ratio of gasified fuel-air mixture in internal combustion engines such as engines used for motor vehicles. The internal combustion engine having the electronically controlled fuel injection device of the type described is of such an arrangement that, for example, a fuel injection time is determined commensurate to an intake air flowrate of the engine, an engine rotational speed and the like, and an air-fuel ratio of the engine is controlled by opening an injector provided on an intake manifold, for example, for flowing out fuel into an air intake port of the engine only for the aforesaid fuel injection time. The electronically controlled fuel injection devices of the type described have been widely used for the engines of motor vehicles, to which is adopted exhaust gas purification measure, requiring precise control of the air-fuel ratio.

Recently, there has been tried to feed part of intake air to a position close to a nozzle of an injector so as to facilitate the atomization of fuel blown out of the injector under the air flow velocity, thus achieving an effect to a certain extent. As shown in FIGS. 1 and 2, the air assist device of the type described comprises: an air assisted injector 14 provided close to a nozzle 14*a* thereof with an adapter 16 for the air assist, constituting an assist air introducing portion 18; a fuel delivery pipe 20 for supplying fuel to the air assisted injector 14; an assist air path 22 formed in the intake manifold 12 for supplying assist air to the assist air introducing portion 18; a ring shaped abutting rubber seal 24 additionally functioning as a heat insulator for shutting the periphery of the adapter 16 off the interior of the intake manifold 12; and also a ring-shaped abutting rubber seal 26 for shutting the periphery of the adapter 16 off the atmosphere, whereby, for example, assist air introduced through a small number of elliptical assist air intake ports 16*a* into the assist air introducing portion 18 is blown out of an assist air jet 16*b* formed at the bottom of the adapter 16 together with fuel, so that the atomization of fuel can be facilitated. In the drawings, designated at 28 is an assist air pipe line, 30 a flange, 32 a bolt, 12*a* a mounting hole for the air assisted injector 14, 14*b* a pintle of the air assisted injector 14, and 14*c* a housing of the air assisted injector 14.

The air assist device of the type described makes it possible to facilitate the atomization of fuel blown out of the nozzle of the air assisted injector 14, and heretofore, in order to minimize the loss in pressure in the assist air path, the diameter of each opening of the assist air intake ports 16*a* has been made as large as allowable in design, or each opening has been formed into an elliptical shape or the like. However, in order to maximize the air assist effect, a diameter A of an opening of an assist air jet 16*b* is contracted. In consequence, if extraneous matters, which have made ingress into the assist air path 22 from some cause or other, enter the adapter 16 through the assist air intake ports 16*a* and block the assist air jet 16*b*, whereby fuel cannot satisfactorily be supplied to the relevant cylinder, thus possibly causing a misfire. Additionally, when the assist air intake ports 16*a* are formed into elliptical shapes, unbalanced portions have been formed in the flow of assist air, thereby possibly resulting in unsatisfactory atomizing of fuel.

Furthermore, heretofore, there have been cases where satisfactory atomization of fuel should not necessarily be made depending upon the direction of introducing assist air into the adapter 16. To obviate the above-described disadvantages, there has been proposed an air assist device, in which there is provided a swirl injector for rendering swirls to injected fuel. Or, there has been proposed an air assist device, in which there is provided at the forward end of the air assisted injector 14 inclosely attached state a cap-shaped adapter 16 formed along an inner wall thereof with assist air introducing grooves 18*a* for communicating the assist air intake ports 16*a* and the assist air jet 16*b* with each other as shown in FIGS. 3 and 4, and the aforesaid assist air introducing grooves are disposed in directions tangential to the assist air jet 16*b* so as to further render swirls to the flow of assist air. The former is advantageous in the case of a constant flow which is produced by a one-point injection obtained by the provision of an injector in a throttle body, however, not advantageous in the case of a multiple point injection in which injectors are provided on respective cylinders and opened for a short period of time. The latter is complicated in construction, and moreover, has assist air introducing portions constituted by narrow grooves, whereby an assist air flowrate becomes insufficient due to the loss in pressure, thus unabling to achieve the practical results.

SUMMARY OF THE INVENTION

The present invention has been developed to obviate the above-described disadvantages of the prior art and has as its first object the provision of an air assist device of a fuel injection type internal combustion engine, wherein extraneous matters do not block the air assisted injector and thereabout, so that high reliability of operation of the air assisted injector is obtainable, and moreover, loss in pressure of assist air by the assist air intake ports can be minimized.

In addition to the aforesaid first object, the present invention has as its second object the provision of an air assist device of a fuel injection type internal combustion engine, wherein even when the forward end of the injector projects into the assist air jet or a pintle of the injector projects into the assist air jet, extraneous matters do not block the jet or are bitten in thereabout.

In addition to the aforesaid first object, the present invention has as its third object the provision of an air assist device of a fuel injection type internal combustion engine, wherein assist air is prevented from having unbalanced portions in its flow.

The present invention has as its fourth object the provision of an air assist device of a fuel injection type internal combustion engine, wherein swirls are reliably rendered to assist air with a simplified construction, so that fuel atomizing perormance can be improved, consequently, fuel adhered to innerwalls of an intake manifold and the like is reduced in amount, and an air-fuel ratio during transitions stabilized, so that the exhaust gas purifying performance and the engine driving performance can be improved.

In addition to the aforesaid fourth object, the present invention has as its fifth object the provision of an air assist device of a fuel injection type internal combustion engine, wherein intensified assist air swirls can be reliably generated.

To achieve the aforesaid first object, the present invention contemplates that, in an air assist device of a fuel injection type internal combustion engine, comprising: an air assisted injector for blowing out assist air together with fuel to facilitate the atomization of fuel; and an adapter formed on the peripheral wall thereof with assist air intake ports constituting an assist air introducing portion close to a nozzle of the air assisted injector and provided at the bottom thereof with an assist air jet, the diameter of each opening of the assist air intake ports is made smaller than the diameter of an opening of the assist air jet, and the assist air intake ports are provided in a plural number, so that the total opening area of the assist air intake ports can be made larger than the opening area of the assist air jet.

To achieve the aforesaid second object, the present invention contemplates that the diameter of each opening of the plurality of assist air intake ports is made smaller than the minimum effective opening diameter of the assist air jet, and the total opening area thereof is made larger than the maximum effective opening area of the assist air jet.

To achieve the aforesaid third object, the present invention contemplates that the plurality of assist air intake ports are disposed at symmetrical positions with respect to the axial line of the air assisted injector.

To achieve the aforesaid fourth object, the present invention contemplates that, in the air assist device of a fuel injection type internal combustion engine as described above, the assist air intake ports are penetrated in directions tangential to the inner wall surface of the adapter.

To achieve the aforesaid fifth object, the present invention contemplates that the wall thickness of the peripheral wall of the adapter is made large.

To achieve the aforesaid fifth object, the present invention contemplates the outlet sides of the assist air intake ports are contracted as compared with the inlet sides thereof.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE INVENTION

Detailed description will hereunder be given of the embodiments of the present invention with reference to the drawings.

Figure 1:
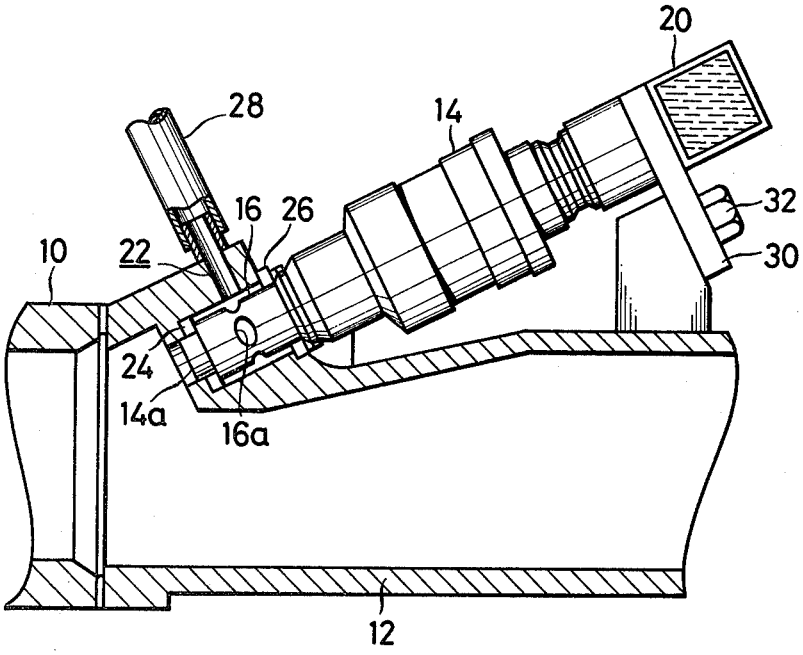
FIG. 1 PRIOR ART
FIG. 1 is a fragmentary sectional view showing the arrangement of the air assist device of a fuel injection type internal combustion engine, which has been already proposed.
Figure 2:
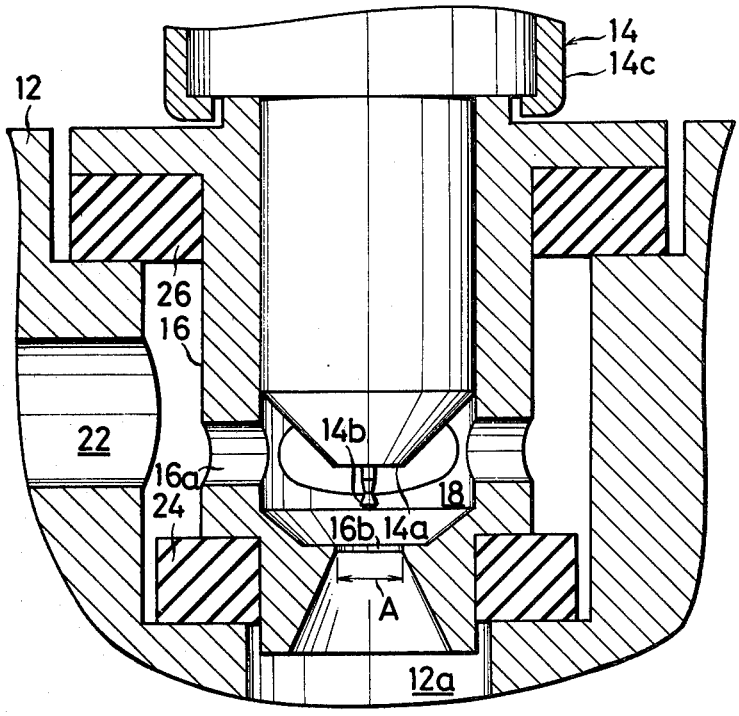
FIG.2 PRIOR ART
FIG. 2 is an enlarged sectional view showing the nozzle of the injector and thereabout.
Figure 3:
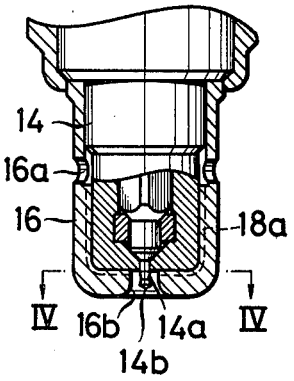
FIG.3 PRIOR ART
FIG. 3 is a sectional view showing the arrangement of the forward end portion of the air assist injector, which has been already proposed.
Figure 4:
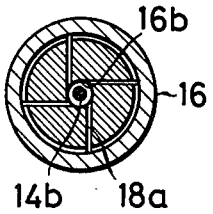
FIG.4 PRIOR ART
FIG. 4 is a cross-sectional view taken along the line IV—IV in FIG. 3.
Figure 5:
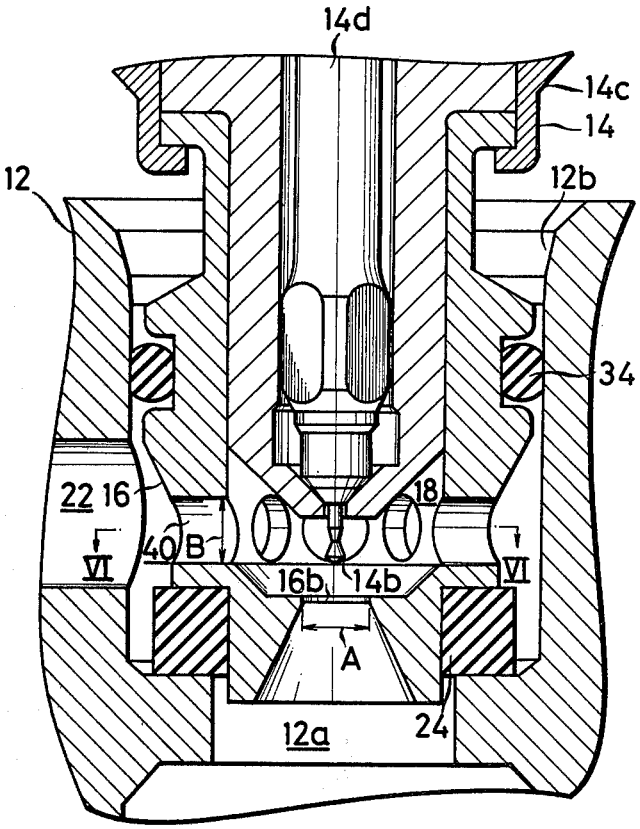
FIG. 5 is a sectional view showing the arrangement of a first embodiment of the air assist device of a fuel injection type internal combustion engine according to the present invention.
Figure 6:
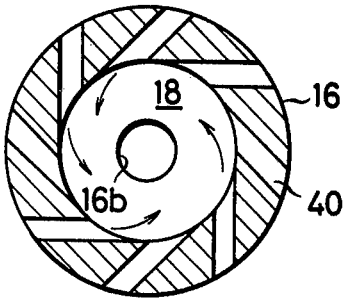
FIG. 6 is a cross-sectional view taken along the line VI—VI in FIG. 5.

As shown in FIGS. 5 and 6, the first embodiment of the present invention is of such an arrangement that, in an air assist device of a fuel injection type internal combustion engine, comprising: an air assisted injector 14, an adapter 16; an assist air introducing portion 18; an assist air path 22 and a rubber seal 24, similarly to the aforesaid prior art example, the diameter B of each round-shaped opening of assist air intake ports 40 is made smaller than an opening diameter A of an assist air jet **16*b* and the total opening area of the assist air intake ports 40 is made larger than the opening area of the assist air jet 16*b*, the assist air intake ports 40 in a plural number are disposed at symmetrical positions with respect to the axial line of the air assisted injector 14, and the respective assist air intake ports 40 are penetrated in directions tangential to the inner wall surface of the adapter 16** having a large wall thickness.

In the drawings, designated at 34 is an O-ring, **12*b* a multi-stage chamfered portion for facilitating the assembling work of the air assisted injector, to which is previously coupled the O-ring 34, and 14*d* a needle of the air assisted injector 14**. The present embodiment is similar to the prior art example in other respects, so that detailed description thereof will be omitted.

In the present embodiment, the extraneous matters, which have entered the adapter 16 and thereabout through the assist air path 22, are firstly precluded by the assist air intake ports 40 from making ingress into the assist air introducing portion 18, whereby no extraneous matters being large in size enter the adapter 16, so that the assist air jet **16*b* can avoid being blocked by the extraneous matters. In this connection, the total opening area of the assist air intake ports 40 is made larger than the opening area of the assist air jet 16*b*, so that the loss in pressure due to the assist air intake ports 40 each having a small diameter can be minimized. Further, the assist air intake ports 40 are disposed at the symmetrical positions with respect to the axial line of the air assisted injector 14, whereby no unbalanced portions occur in the flow of assist air, so that the atomization of fuel can be effectively carried out. Furthermore, swirls are generated in the assist air, which has been introduced into the assist air introducing portion 18 from the assist air path 22 through the assist air intake ports 40 of the adapter 16, so that the atomization of fuel blown out of the assist air jet 16***b* into the intake manifold 12 can be more reliably effected.

Figure 7:
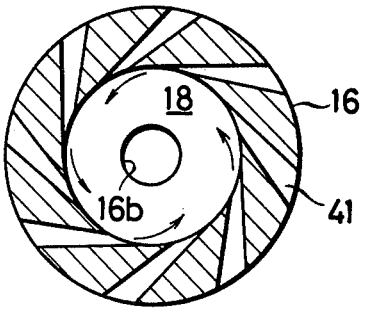
FIG. 7 is a cross-sectional view showing the arrangement of the essential portions of a modification of the first embodiment.

In the present embodiment, the cross-sectional shapes of the assist air intake ports 40 in the flowing direction of assist air are made identical with one another, so that the assist air intake ports 40 can be comparatively easily formed in production. In addition, the cross-sectional shapes of the assist air intake ports in the flowing direction of assist air should not necessarily be limited to ones shown in the above-described embodiment, but, for example, the assist air outlet sides of assist air intake ports 41 may be contracted as compared with the assist air inlet sides as in an example of modification shown in FIG. 7. In this case, the swirls of assist air is more intensified, so that the atomization of fuel can be further facilitated. Furthermore, the directions of penetration of the assist air intake ports 40 should not necessarily be limited to the aforesaid embodiment, but, for example, the assist air intake ports 40 may be penetrated in directions perpendicular to the outer peripheral wall of the adapter 16. In this case, the assist air intake ports may be very simply formed in production.

Figure 8:
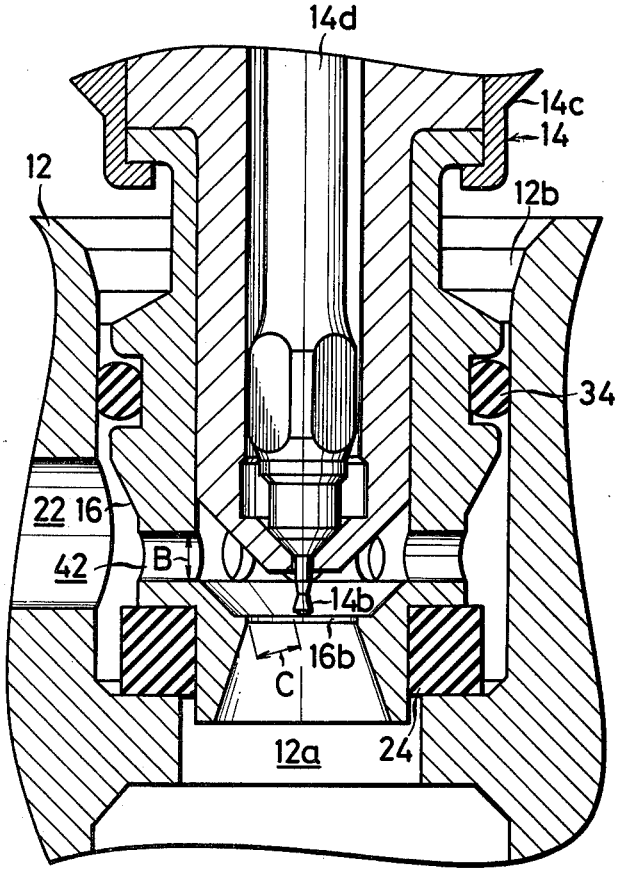
FIG. 8 is a sectional view showing the arrangement of a second embodiment of the air assist device of a fuel injection type internal combustion engine according to the present invention.

Detailed description will hereunder be given of the second embodiment of the present invention with reference to FIG. 8.

The present embodiment is of such an arrangement that, in an air assist device of a fuel injection type internal combustion engine, comprising: an air assisted injector 14; and adapter 16; an assist air introducing portion 18; an assist air path 22; a rubber seal 24 and the O-ring 34, similarly to the aforesaid prior art example or the first embodiment, the diameter B of each round-shaped opening of assist air intake ports 42 is made smaller than the minimum effective opening diameter C of the assist air jet 16*b* when the pintle 14*b* projects to the maximum extent and the total opening area of the assist air intake ports 42 is made larger than the maximum effective opening area of the assist air jet 16*b* when the pintle 14*b* is retracted to the maximum extent, and the assist air intake ports 42 in a plural number are disposed at the symmetrical positions with respect to the axial line of the air assist injector 14. The present embodiment is similar to the prior art example or the aforesaid first embodiment in other respects, so that detailed description thereof will be omitted.

In the present embodiment, the extraneous matters are prevented from blocking the assist air jet 16*b* of the adapter 16 of the air assisted injector 14, and moreover, malfunction of the air assisted injector 14 can be avoided, which may be caused by the extraneous matters bitten in across the adapter 16 of the air assisted injector 14 and the forward end of the pintle 14*b*.

In addition, in the respective above-described embodiments, the air assisted injector 14 is mounted onto the intake manifold 12, however, the mounting position of the air assisted injector 14 should not necessarily be limited to the above, but needless to say, the air assisted injector 14 may be secured to a cylinder head of the engine, for example.

It should be apparent to those skilled in the art that the abovedescribed embodiments are merely representative, which represent the applications of the principles of the present invention. Numerous and varied other arrangements can be readily devised by those skilled in the art without departing from the spirit and the scope of the invention.

What is claimed is:

1. An air assist device of a fuel injection type internal combustion engine, comprising:

an air assisted injector for blowing out assist air together with fuel to facilitate the atomization of fuel; and an adapter having an annular peripheral wall containing a plurality of assist air intake ports constituting an assist air introducing portion close to a nozzle of said air assisted injector and having at the bottom of said wall an assist air jet opening, wherein the diameter of each opening of the assist air intake ports is smaller than the diameter of the assist air jet opening, the total opening area of the assist air intake ports being larger than the area of the assist air jet opening.

2. An air assist device of a fuel injection type internal combustion engine as set forth in claim 1, wherein the diameter of each opening of the plurality of assist air intake ports is smaller than the minimum effective diameter of said assist air jet opening, and the total opening area of said ports is larger than the maximum effective area of said assist air jet opening.

3. An air assist device of a fuel injection type internal combustion engine as set forth in claim 1 or 2, wherein said plurality of assist air intake ports are disposed at symmetrical positions with respect to the axial line of said air assisted injector.

4. An air assist device of a fuel injection type internal combustion engine as set forth in claim 1 or 2, wherein said plurality of assist air intake ports are penetrated in directions tangential to the inner wall surface of said adapter.

5. An air assist device of a fuel injection type internal combustion engine as set forth in claim 4, wherein the assist air outlet sides of said assist air intake ports are contracted as compared with the assist air inlet sides.

6. An air assist device of a fuel injection type internal combustion engine as set forth in claim 1 or 2, wherein said plurality of assist air intake ports are penetrated in directions perpendicular to the inner wall surface of said adapter.

7. An air assist device of a fuel injection type internal combustion engine as set forth in claim 1 or 2, wherein each opening of said plurality of assist air intake ports is formed into a round shape.

8. An air assist device of a fuel injection type internal combustion engine, comprising:

an air assisted injector for blowing out assist air together with fuel to facilitate the atomization of fuel; and an adapter having an annular peripheral wall of large thickness and containing assist air intake ports constituting an assist air introducing portion close to a nozzle of said air assisted injector and having at the bottom of said wall an assist air jet, wherein said assist air intake ports are penetrated in directions tangential to the inner surface of said wall, and wherein each of said ports converge inwardly.

9. An air assist device of a fuel injection type internal combustion engine as set forth in claim 8, wherein each opening of said assist air intake ports is formed into a round shape.

* * * * *